US008397956B2

(12) United States Patent
Olechowski

(10) Patent No.: US 8,397,956 B2
(45) Date of Patent: Mar. 19, 2013

(54) DISPENSING VALVE WITH IMPROVED DISPENSING

(75) Inventor: Gregory M. Olechowski, Rhodes, MI (US)

(73) Assignee: AptarGroup, Inc., Crystal Lake, IL (US)

( * ) Notice: Subject to any disclaimer, the term of this patent is extended or adjusted under 35 U.S.C. 154(b) by 1143 days.

(21) Appl. No.: 11/728,659

(22) Filed: Mar. 27, 2007

(65) Prior Publication Data

US 2008/0237271 A1 Oct. 2, 2008

(51) Int. Cl.
*B65D 5/72* (2006.01)

(52) U.S. Cl. ..... 222/494; 222/490; 222/213

(58) Field of Classification Search ..... 222/490, 222/491, 493, 494, 212, 213; 251/149.1, 251/331; 137/849, 859
See application file for complete search history.

(56) References Cited

U.S. PATENT DOCUMENTS

| | | | | |
|---|---|---|---|---|
| 5,409,144 | A | 4/1995 | Brown | |
| 6,273,296 | B1 * | 8/2001 | Brown | 222/92 |
| 6,273,305 | B1 | 8/2001 | Fioravanti et al. | |
| 6,293,437 | B1 | 9/2001 | Socier et al. | |
| 6,367,668 | B1 * | 4/2002 | Schwanenberg | 222/490 |
| 6,371,340 | B1 * | 4/2002 | Pateman et al. | 222/494 |
| H2027 | H | 6/2002 | Brown et al. | |
| 6,405,901 | B1 | 6/2002 | Schantz et al. | |
| 6,427,874 | B2 | 8/2002 | Brown et al. | |
| 6,543,652 | B1 * | 4/2003 | Kelder et al. | 222/212 |
| 6,726,063 | B2 * | 4/2004 | Stull et al. | 222/212 |
| 6,769,577 | B1 | 8/2004 | Feierabend | |
| 6,786,363 | B1 * | 9/2004 | Lohrman | 222/213 |
| 6,910,607 | B2 | 6/2005 | Gaiser et al. | |
| 6,971,558 | B2 * | 12/2005 | Ramsey et al. | 222/492 |
| 2006/0249545 | A1 * | 11/2006 | Ramsey | 222/494 |
| 2007/0114250 | A1 * | 5/2007 | Langseder et al. | 222/494 |
| 2008/0264979 | A1 * | 10/2008 | Nijland et al. | 222/494 |

FOREIGN PATENT DOCUMENTS

| | | |
|---|---|---|
| WO | WO 98/14386 | 4/1998 |
| WO | WO 99/10247 | 3/1999 |

OTHER PUBLICATIONS

Drawings PA 1, PA 2, PA 3, PA 4, PA 5, PA 6, PA 7, and PA 8.

* cited by examiner

*Primary Examiner* — Kevin P Shaver
*Assistant Examiner* — Robert Nichols, II
(74) *Attorney, Agent, or Firm* — Wood, Phillips, Katz, Clark & Mortimer

(57) ABSTRACT

A fluid dispensing valve is provided with a peripheral mounting portion and a connecting sleeve connecting the peripheral mounting portion with a head which defines a dispensing orifice. The valve head includes a recessed exterior surface and an inwardly projecting interior surface. The valve head has a peripheral surface extending from the exterior surface toward the interior surface. The connector sleeve is connected to the valve head at a location that is at the most axially inward extent of the peripheral surface.

12 Claims, 16 Drawing Sheets

DISPENSING VALVE WITH IMPROVED DISPENSING

TECHNICAL FIELD

The present invention relates to a liquid dispensing system for dispensing liquid from a supply of liquid through a flexible, resilient valve which has a head that defines a normally closed dispensing orifice and that is displaceable outwardly to an open configuration when the pressure on the valve interior side exceeds the pressure on the valve exterior side by a predetermined amount.

BACKGROUND OF THE INVENTION AND TECHNICAL PROBLEMS POSED BY THE PRIOR ART

Various types of liquid supply systems, including portable, dispensing containers, have become popular for use with a variety of fluid substances, including lotions, shampoos, cleaning liquids, beverages, other liquid food products, etc. One type of container comprises a generally flexible bottle with a dispensing closure having a dispensing aperture and a cap or lid that is hingedly connected, or releasably attachable, to the body of the closure and that can be opened to expose the dispensing aperture. The bottle can then be tipped and squeezed to discharge the fluid product. The lid can be returned to the closed position to prevent spillage if the container is dropped or tipped over. The closed lid may also help keep the contents fresh and may reduce the ingress of contaminants.

One type of closure for these kinds of containers also includes a flexible, self-closing, slit-type dispensing valve mounted in the closure over the container opening. The valve has a slit or slits which define a normally closed orifice that opens to permit flow therethrough in response to increased pressure within the container when the container is squeezed. The valve automatically closes to shut off flow therethrough upon removal of the increased pressure.

Designs of such valves and of closures using such valves are illustrated in the U.S. Pat. No. 5,271,531, U.S. Pat. No. 5,927,566, and U.S. Pat. No. 5,934,512. Typically, the closure includes a body or base mounted on the container neck to define a seat for receiving the valve and includes a retaining ring or other structure for holding the valve on the seat in the base. See, for example, U.S. Pat. No. 6,269,986 and U.S. Pat. No. 6,616,016. The valve is normally closed and can withstand the weight of the fluid product when the bottle is completely inverted so that the fluid will not leak out unless the bottle is squeezed. With such an improved system, the lid or cap need not be re-closed.

While such a valved dispensing system has significant advantages and functions well, it would be desirable to provide an improved system that would better accommodate opening of the valve at lower container pressures, and with more control and reduced tendency to spurt.

It would also be beneficial to provide an improved valve for a squeezable container wherein the valve has the capability to allow ambient air to vent back through the valve and into the container after the desired quantity of fluid product has been dispensed so as to equalize the container pressure with the ambient air pressure to facilitate return of the squeezed container wall(s) to the normal, undeformed shape.

It would also be advantageous if such an improved valve could be readily incorporated in a dispensing closure system that could accommodate various liquid supply systems, including bottles, containers, sports hydration backpack fluid dispensing systems, etc., which have a variety of shapes and that are constructed from a variety of materials.

Also, it would be beneficial if such an improved valve could accommodate designs that would permit the valve to be retained in the container or other system component with a retaining ring or other means, such as swaging, sonic welding, bonding, coining, etc.

Further, it would be desirable if such an improved valve could accommodate efficient, high-quality, large volume manufacturing techniques with a reduced product reject rate to produce a valve with consistent operating characteristics unit-to-unit.

The present invention provides an improved dispensing valve and dispensing system which can accommodate designs having one or more the above-discussed benefits and features.

SUMMARY OF THE INVENTION

According to a broad aspect of the present invention, an improved valve, which can be used in a dispensing closure system, is provided to better control the dispensing action with less of a tendency to spurt.

According to one broad aspect of the invention, a fluid dispensing valve is provided with a generally circular configuration relative to a longitudinal axis along which a fluid substance can be dispensed from the valve in a discharge flow direction. The valve has an axially outward direction that is defined by the discharge flow direction, and said valve has an axially inward direction that is defined as the direction opposite to the axially outward direction. The valve includes a peripheral mounting portion, a valve head, and a connector sleeve connecting the valve head and peripheral mounting portion. The valve head is flexible and resilient. The valve head has (1) a normally closed orifice that is defined by at least one slit and that can open to permit a discharge flow of the substance, and (2) a fully retracted, closed position that is axially inward of at least another part of the valve. The valve head also has an exterior surface which (1) can interface with the environment on the valve exterior, and (2) has a generally recessed configuration as viewed from the valve exterior when the valve head is in the fully retracted, closed position. The valve head also has an interior surface which (1) can interface with a fluid substance on the valve interior, and (2) projects generally in the axially inward direction when viewed from the valve interior when the valve head is in the fully retracted, closed position. The valve head also has a peripheral surface extending from the exterior surface toward the interior surface.

The connector sleeve is flexible and resilient, and the sleeve defines a generally tubular shape over at least part of the sleeve length. The connector sleeve extends between, and connects, the peripheral mounting portion and said valve head in a configuration that, when the valve is subjected to a sufficient pressure differential, doubles over and extends rollingly in the axially outward direction as the valve head moves from the fully retracted, closed position to an extended position that is axially outward of the fully retracted, closed position to accommodate the opening of the orifice. The connector sleeve is connected to the valve head at a location that is at the most axially inward extent of the valve head peripheral surface.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

DESCRIPTION OF THE PREFERRED EMBODIMENTS

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, many of the figures illustrating the invention show a closure compromising a dispensing valve in a two-piece dispensing fitment, and the closure is shown in the typical orientation that the closure would have at the top of a container when the container is stored upright on its base, and terms such as upper, lower, horizontal, etc., are used with reference to this position. It will be understood, however, that the valve of this invention may be manufactured, stored, transported, used, and sold in an orientation other than the position described.

The valve of this invention is suitable for use with a variety of conventional or special dispensing systems, including in discharge sports hydrations systems and in containers having various designs, the details of which, although not illustrated or described, would be apparent to those having skill in the art and an understanding of such containers. Such containers and systems, per se, that are described herein form no part of, and therefore are not intended to limit, the broadest aspects of the valve, per se, of the present invention. It will also be understood by those of ordinary skill that novel and non-obvious inventive aspects are embodied in the described valve alone.

Figure 1:
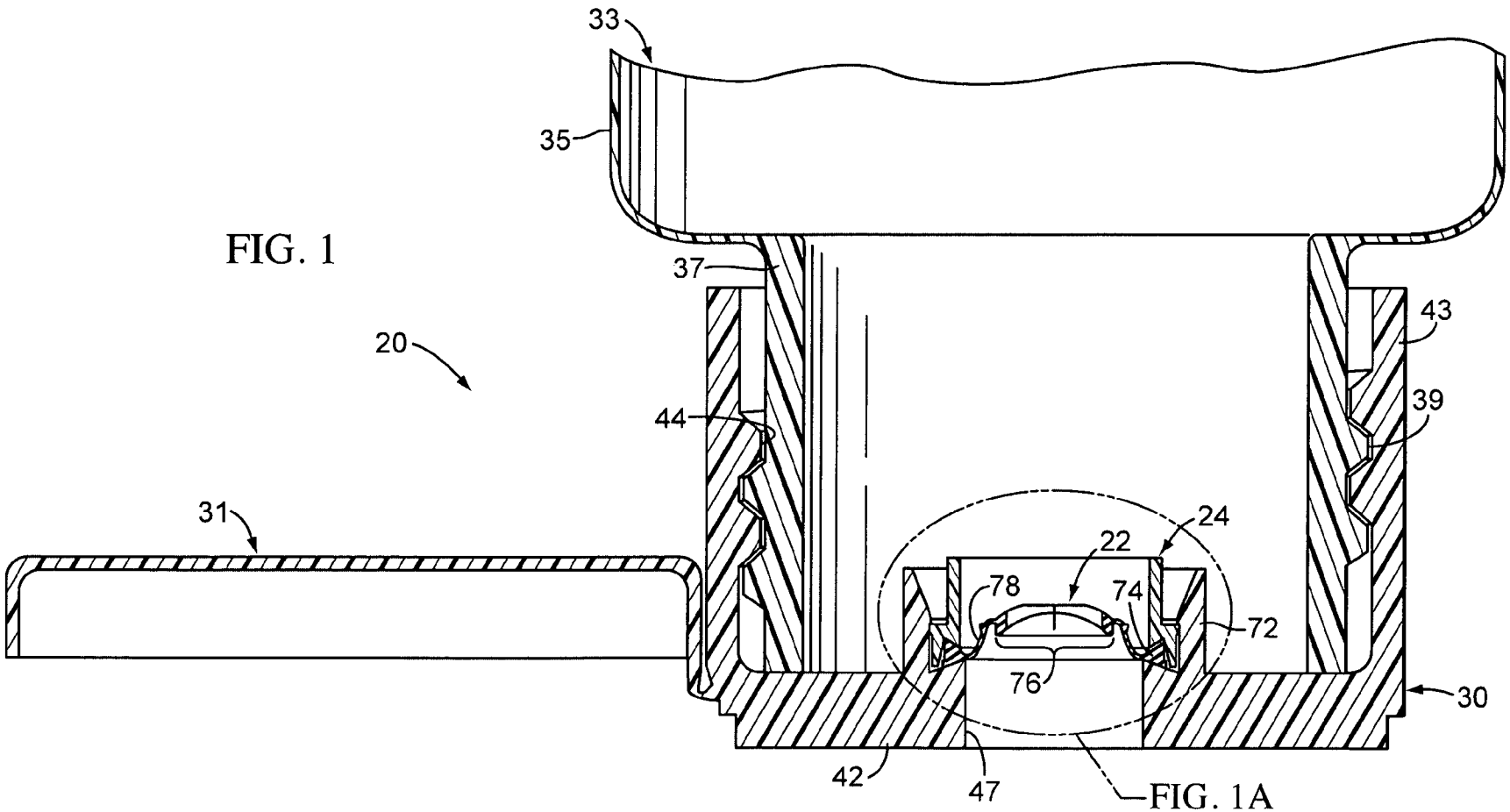
FIG. 1 is a perspective view of a fluid dispensing valve of the present invention contained within a mounting assembly in the form of a closure mounted on a container.

FIGS. 1-15 illustrate a presently preferred, first embodiment of the dispensing valve of the present invention as part of a dispensing closure system or closure that is designated generally by reference number 20 in FIG. 1. In the preferred embodiment illustrated, the dispensing closure 20 includes a dispensing valve 22 that is held by a one-piece mounting ring or retainer ring 24 in a closure body 30 to which a lid 31 is hingedly connected. In other contemplated embodiments (not illustrated), the lid 31 could be a separate, removable lid or could be omitted altogether. The combination of the valve 22, retainer ring 24, and closure body 30 (and lid 31, if used) is regarded as the closure 20.

The illustrated preferred form of the closure 20 is especially adapted to be mounted or installed on a container 33 that would typically contain a fluent material. The container typically includes (1) a body 35, a neck 37 defining an opening to the container interior, and (2) an external, male thread 39 for engaging a mating female thread 44 on the dispensing closure 20. The dispensing closure 20 may also be mounted on or in other types of fluent material dispensing apparatus or systems instead of on a container, per se.

Where the closure 20 is mounted on a container, the container 33 may have a body with any suitable configuration, and the upwardly projecting neck may have a different cross-sectional size and/or shape than the container body. (Alternatively, the container need not have a neck, per se. Instead, the container may consist of just a body with an opening.) The container typically would have a somewhat flexible wall or walls.

Although the container, per se, does not form a part of the broadest aspects of the present invention, per se, it will be appreciated that in one contemplated embodiment (not illustrated) at least a portion of the closure 20 may be provided as a unitary portion, or extension, of the top of the container (or other dispensing system apparatus). However, in the preferred embodiment illustrated, the dispensing closure 20 is a completely separate article or unit (e.g., a separate dispensing closure 20) which comprises the valve 22 together with one or more other closure components and which is adapted to be removably, or non-removably, installed on a previously manufactured container (or other fluent material dispensing apparatus). Hereinafter, the dispensing closure 20 will be more simply referred to as the closure 20.

The illustrated, preferred embodiment of the closure 20 is adapted to be used with a container having an opening to provide access to the container interior and to a product contained therein. The closure 20 can be used to dispense with many materials, including, but not limited to, liquids, suspensions, mixtures, etc. (such as, for example, a material constituting a personal care product, a food product, an industrial or household cleaning product, or other compositions of matter (e.g., compositions for use in activities involving manufacturing, commercial or household maintenance, construction, agriculture, medical treatment, military operations, etc.)).

The container 33 with which the closure 20 may be used would typically be a squeezable container having a flexible wall or walls which can be grasped by the user and squeezed or compressed to increase the internal pressure within the container so as to force the product out of the container and through the opened closure. Such a flexible container wall typically has sufficient, inherent resiliency so that when the squeezing forces are removed, the container wall returns to its normal, unstressed shape. Such a squeezable container is preferred in many applications but may not be necessary or preferred in other applications. For example, in some applications it may be desirable to employ a generally rigid container, and to either pressurize the container interior at selected times with an internal piston (or other pressurizing system), or to reduce the exterior ambient pressure around the exterior of the closure so as to suck the material out through the open closure.

It is presently contemplated that many applications employing the closure 20 will be conveniently realized by molding at least some of the components of the closure 20 from suitable thermoplastic material or materials. In the preferred embodiment illustrated, the retainer ring 24, closure body 30, and closure lid 31 may be molded from a suitable thermoplastic material, such as, but not limited to, polypropylene. The closure components may be separately molded—and may be molded from different materials. The materials may have the same or different colors and textures.

In contemplated alternate embodiments (not illustrated), the valve 22 could be suitably attached to a unitary mounting fitment in the closure or otherwise retained in the closure by various means, including swaging, coining, gluing, ultrasonic welding, etc. In another contemplated alternate embodiment (not illustrated), the closure body 30 could be molded to form a generally rigid, unitary structure, and then the valve 22 could be bi-injection molded onto the body 30 to form the closure without the need for a retainer ring 24.

As can be seen in FIG. 1, the body 30 includes a deck 42 having a skirt 43 that extends downwardly from the deck 42 and that defines the internal, female thread 44 for threadingly engaging the container neck external, male thread 39 when the dispensing closure 20 is installed on the container neck 37.

Alternatively, the closure body 30 could be provided with some other container connecting means, such as a snap-fit bead or groove (not illustrated) for engaging a container neck groove or bead (not illustrated), respectively. Also, the closure body 30 could instead be permanently attached to the container by means of induction melting, ultrasonic welding, gluing, or the like, depending on materials used for the closure body 30 and container 33. The closure body 30 could also be formed as a unitary part, or extension, of the container.

The closure body 30 may have any suitable configuration for accommodating an upwardly projecting neck of the container 33 or for accommodating any other portion of a container that is intended to be received within the particular configuration of the closure body 30—even if a container does not have a neck, per se. The main part of the container or container body 35 may have a different cross-sectional shape than the container neck 37 and closure body 30. The closure body 30 may also be adapted for mounting to other types of dispensing apparatus, machines, or equipment.

The closure body 30 could also include an interior, annular seal structure (not illustrated) for extending downwardly from the underside of the closure body deck 42 adjacent the skirt 43. Such a seal structure could be a conventional double "V" seal, a "plug" profile seal, a "crab's claw" seal, a flat seal, or some other such conventional or special seal, depending upon the particular application.

As can be seen in FIG. 1, the closure body deck 42 defines a discharge passage 47. In another contemplated embodiment (not illustrated), the deck 42 could include an outwardly projecting spout around the passage 47.

Figure 1A:
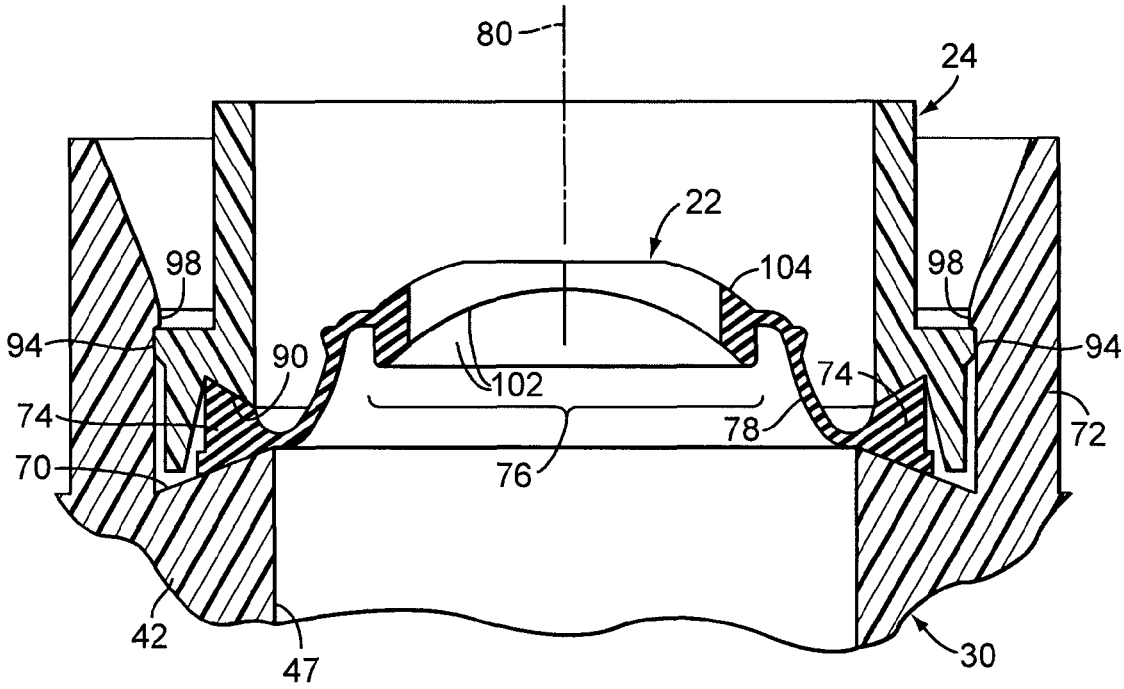
FIG. 1A is an enlarged, cross-sectional view of the area in the oval designated "FIG. 1A" in FIG. 1.

As shown in FIG. 1A, around the discharge passage 47, the deck 42 defines an annular seat 70 for being engaged by a peripheral portion of the valve 22 as described hereinafter. This accommodates the seating of the valve 22 in the closure body 30. The seat surface 70 preferably has a frustoconical configuration and functions as an annular, inwardly angled clamping surface for engaging the peripheral part of the valve 22 as explained in detail hereinafter.

An annular collar 72 (FIG. 1A) extends axially inwardly from the closure body deck 42 around the retainer ring 24 to hold the retainer ring 24 in place as described in detail hereinafter. The preferred embodiment of the valve 22 is a pressure-actuatable, flexible, slit-type valve which is retained against surface 70 on the inside of the closure body 30 by means of the retaining ring 34 as described in detail hereinafter.

The valve 22 is preferably molded as a unitary structure from material which is flexible, pliable, elastic, and resilient. This can include elastomers, such as a synthetic, thermosetting polymer, including silicone rubber, such as the silicone rubber sold by Dow Corning Corp. in the United States of America under the trade designation D.C. 99-595-HC. Another suitable silicone rubber material is sold in the United States of America under the designation Wacker 3003-40 by Wacker Silicone Company. Both of these materials have a hardness rating of 40 Shore A. The valve 22 could also be molded from other thermosetting materials or from other elastomeric materials, or from thermoplastic polymers or thermoplastic elastomers, including those based upon materials such as thermoplastic propylene, ethylene, urethane, and styrene, including their halogenated counterparts.

In the preferred embodiment illustrated, the valve 22 incorporates some of the configuration and structure of a commercially available valve design substantially as disclosed in the U.S. Pat. No. 5,676,289 with reference to the valve 46 disclosed in the U.S. Pat. No. 5,676,289. The configuration and operation of such a type of valve is further described with reference to the similar valve that is designated by reference number 3d in the U.S. Pat. No. 5,409,144.

Figure 5:
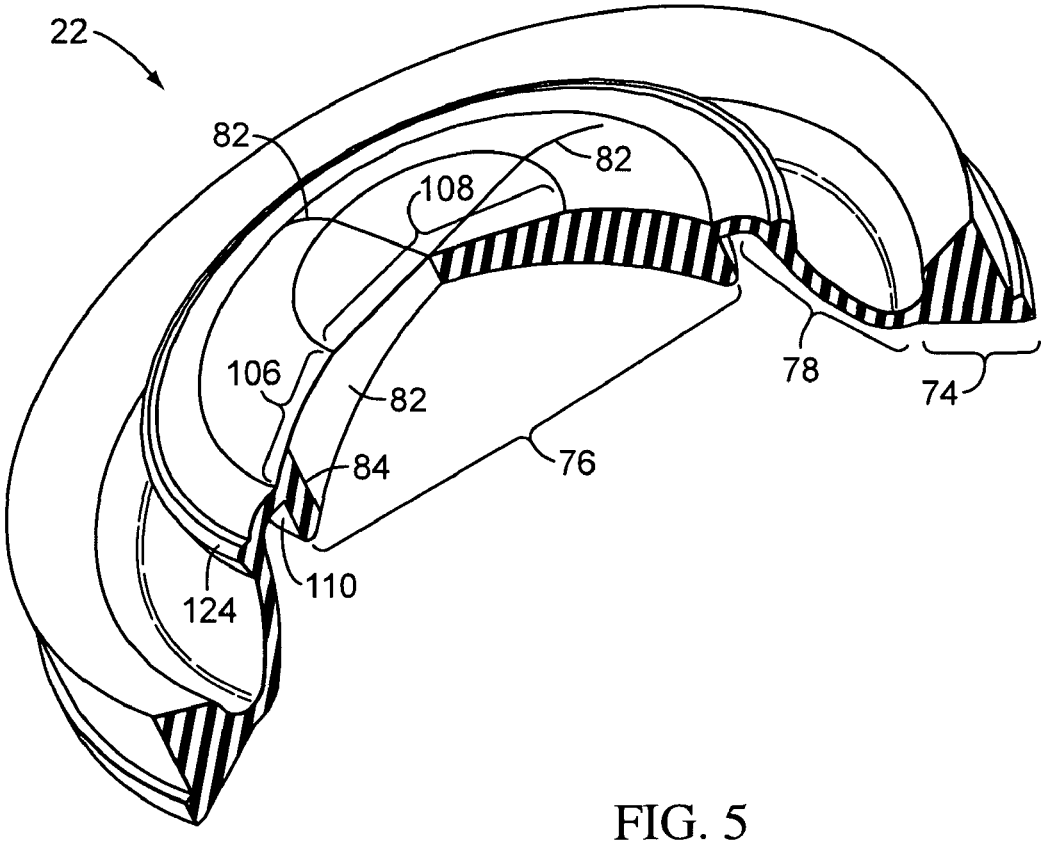
FIG. 5 is a view similar to FIG. 2, but FIG. 5 shows a partial cross section of the valve.
Figure 6:
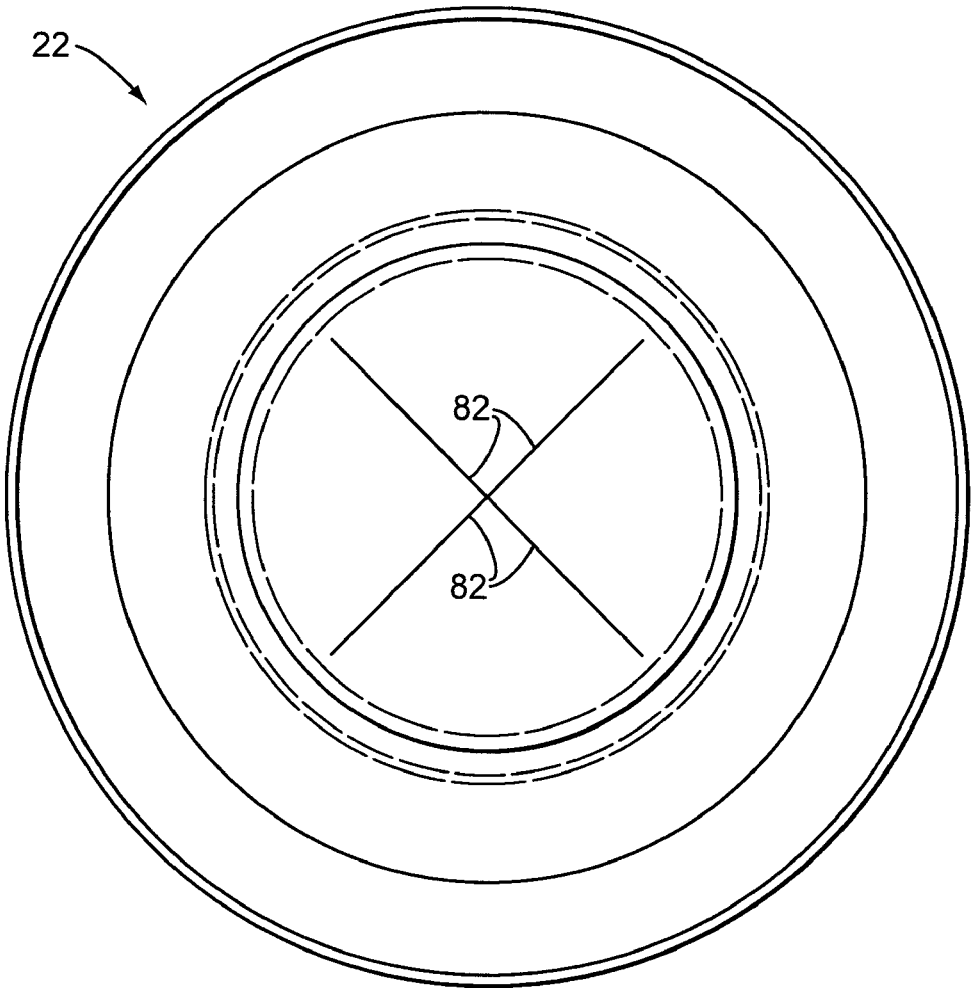
FIG. 6 is a bottom plan view of the exterior surface of the valve.
Figure 9:
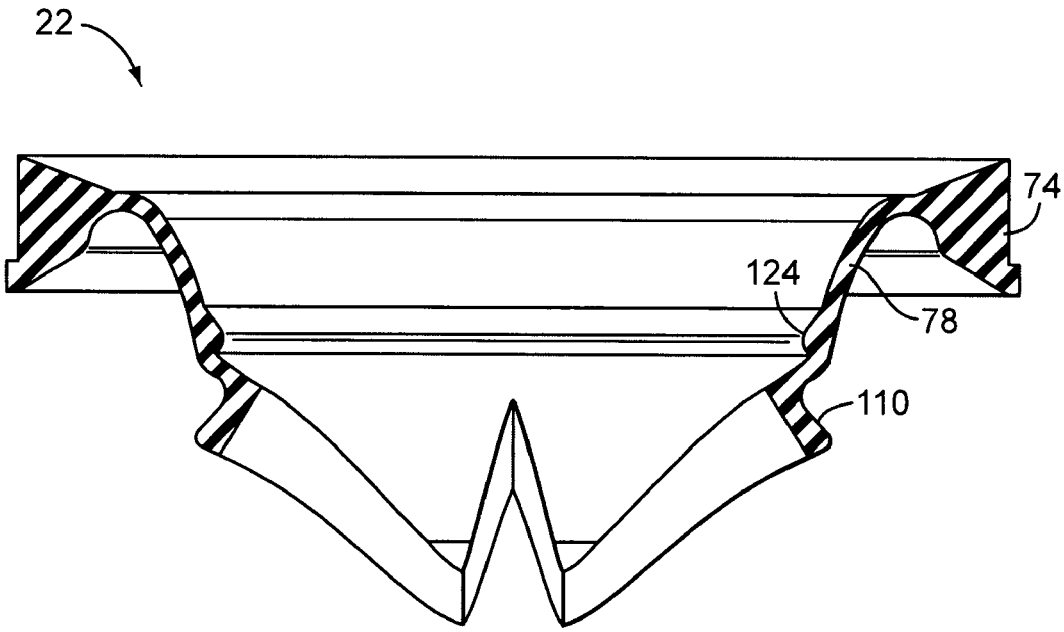
FIG. 9 is a view similar to FIG. 8, but FIG. 9 shows the valve in a fully opened, discharge configuration.
Figure 10:
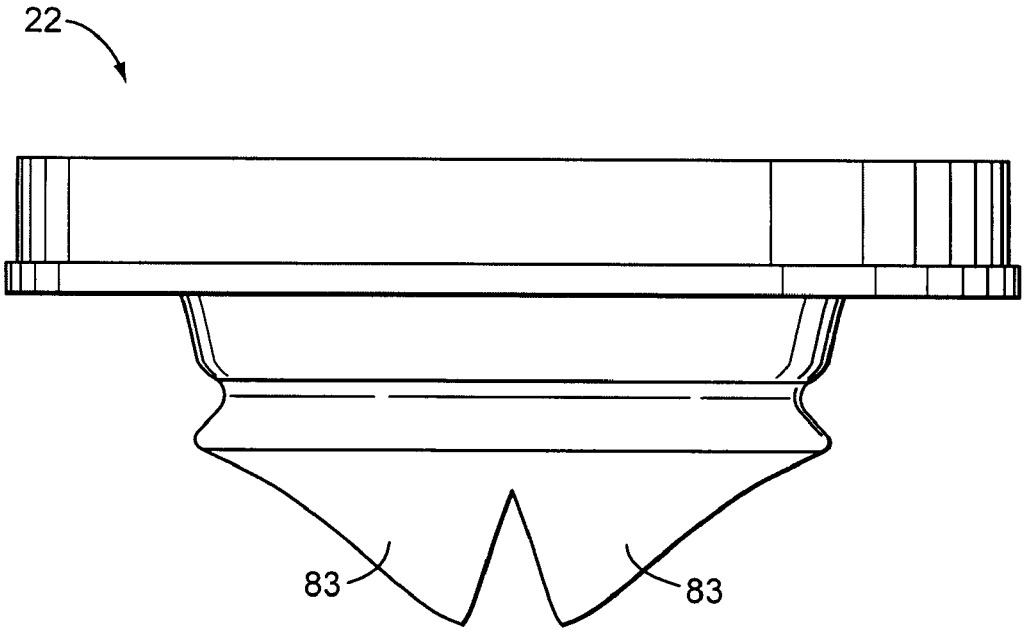
FIG. 10 is a view similar to FIG. 4, but FIG. 10 shows the valve in a fully opened, discharge configuration corresponding to the same configuration illustrated in FIG. 9.
Figure 11:
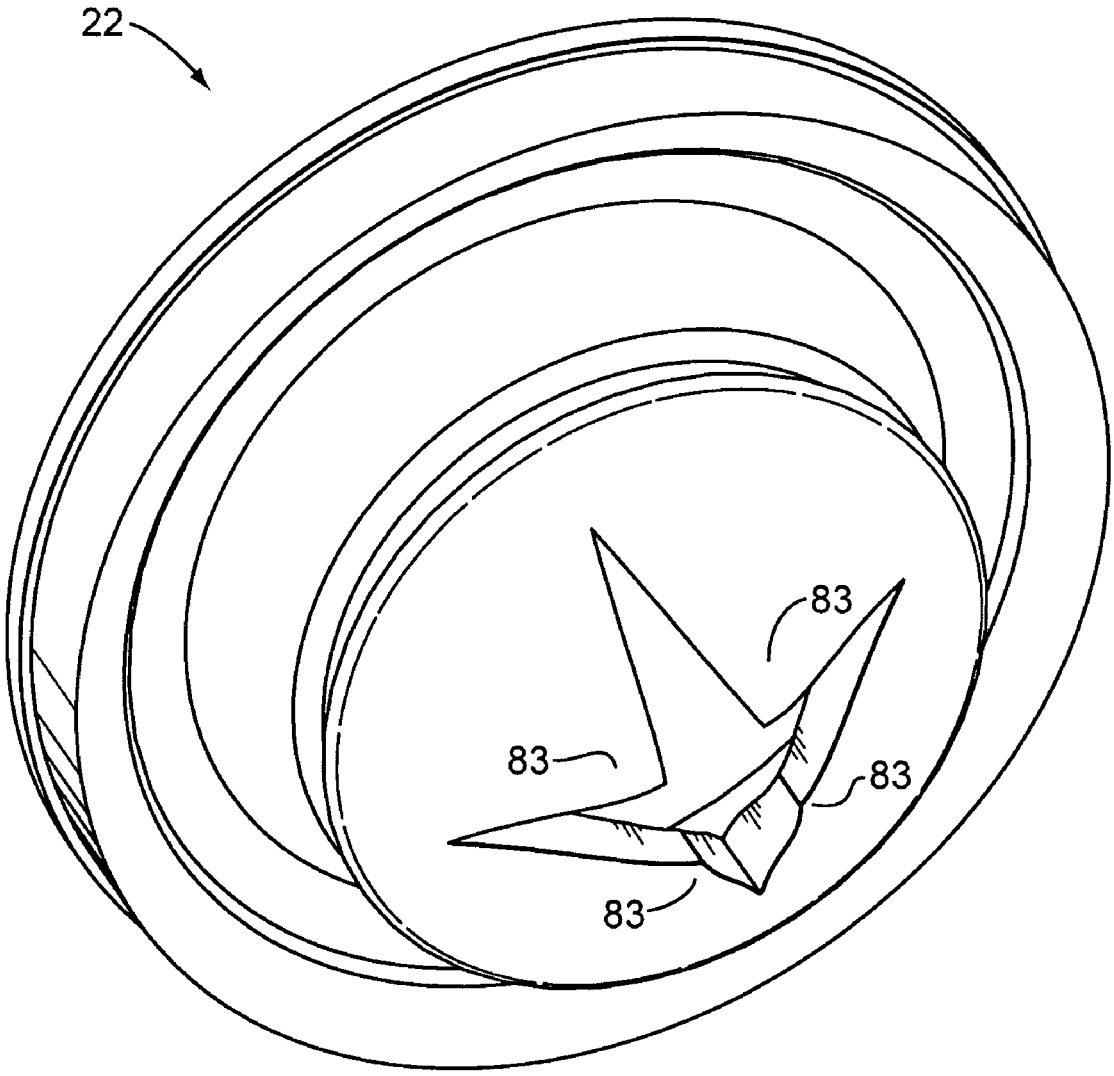
FIG. 11 is a view similar to FIG. 2, but FIG. 11 shows the valve in a fully opened, discharge configuration corresponding to the configurations illustrated in FIGS. 9 and 10.
Figure 12:
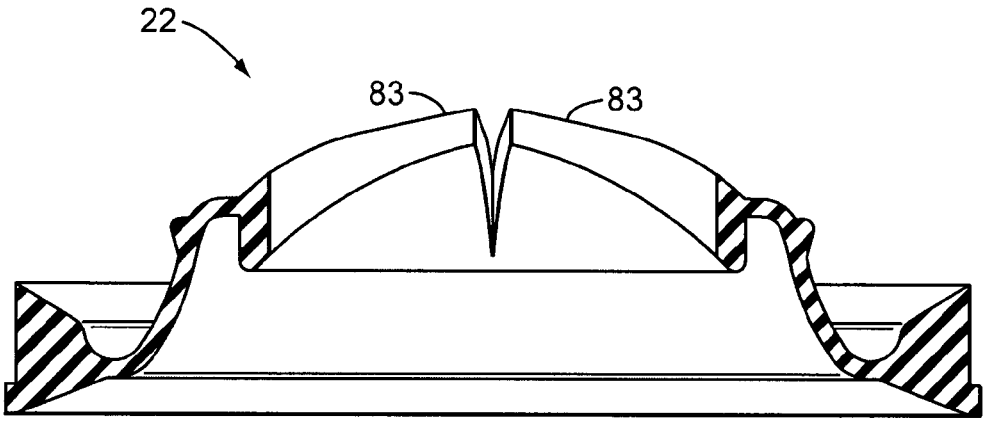
FIG. 12 is a view similar to FIG. 8, but FIG. 12 shows the valve in a partially, inwardly opened, in-venting configuration.
Figure 13:
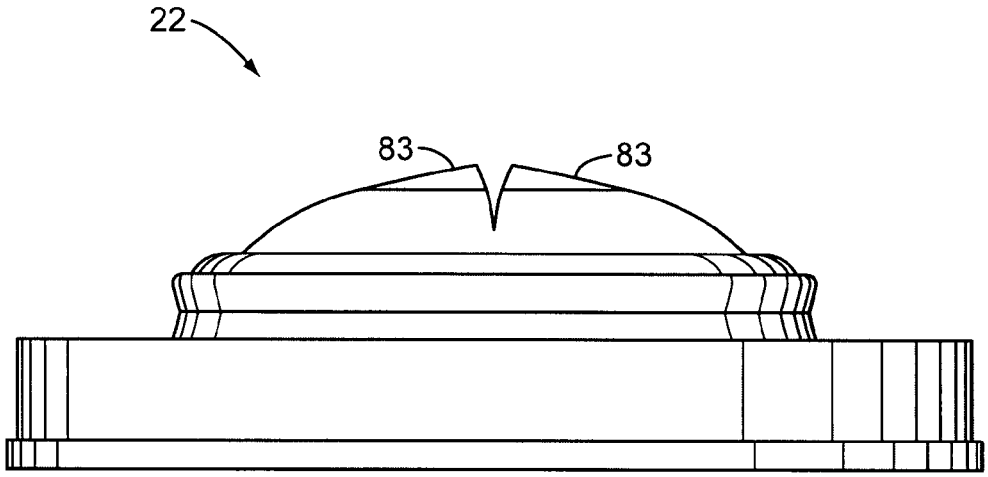
FIG. 13 is a view similar to FIG. 4, but FIG. 13 shows the valve in a partially, inwardly opened, in-venting configuration corresponding to the configuration illustrated in FIG. 12.
Figure 14:
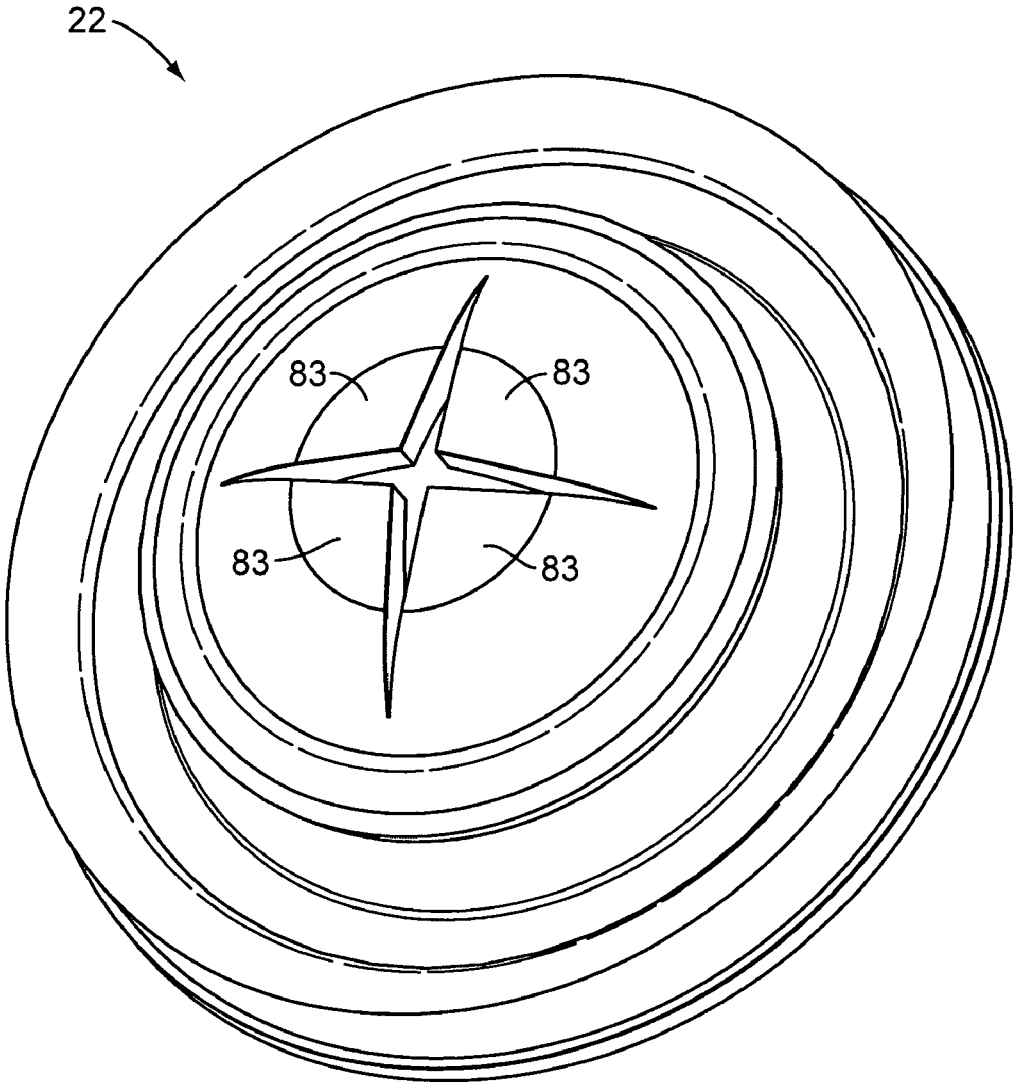
FIG. 14 is an isometric view of the interior surface of the valve shown in FIGS. 2-13, but FIG. 14 shows the valve in a partially opened, in-venting configuration corresponding to the configuration illustrated in FIGS. 12 and 13.
Figure 15:
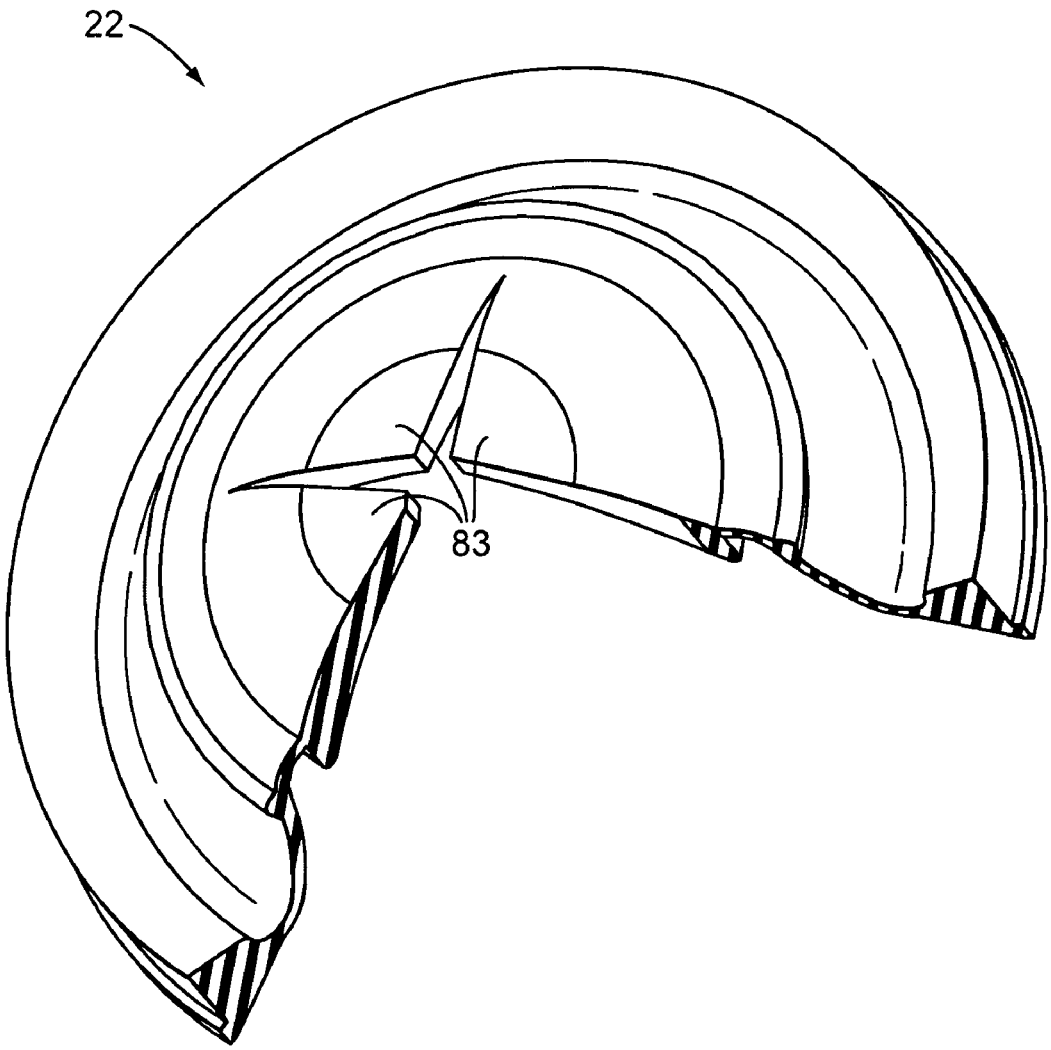
FIG. 15 is a view similar to FIG. 14, but FIG. 15 shows the valve in partial cross section in the partially opened, in-venting configuration corresponding to the configuration illustrated in FIGS. 12-14.
Figure 16:
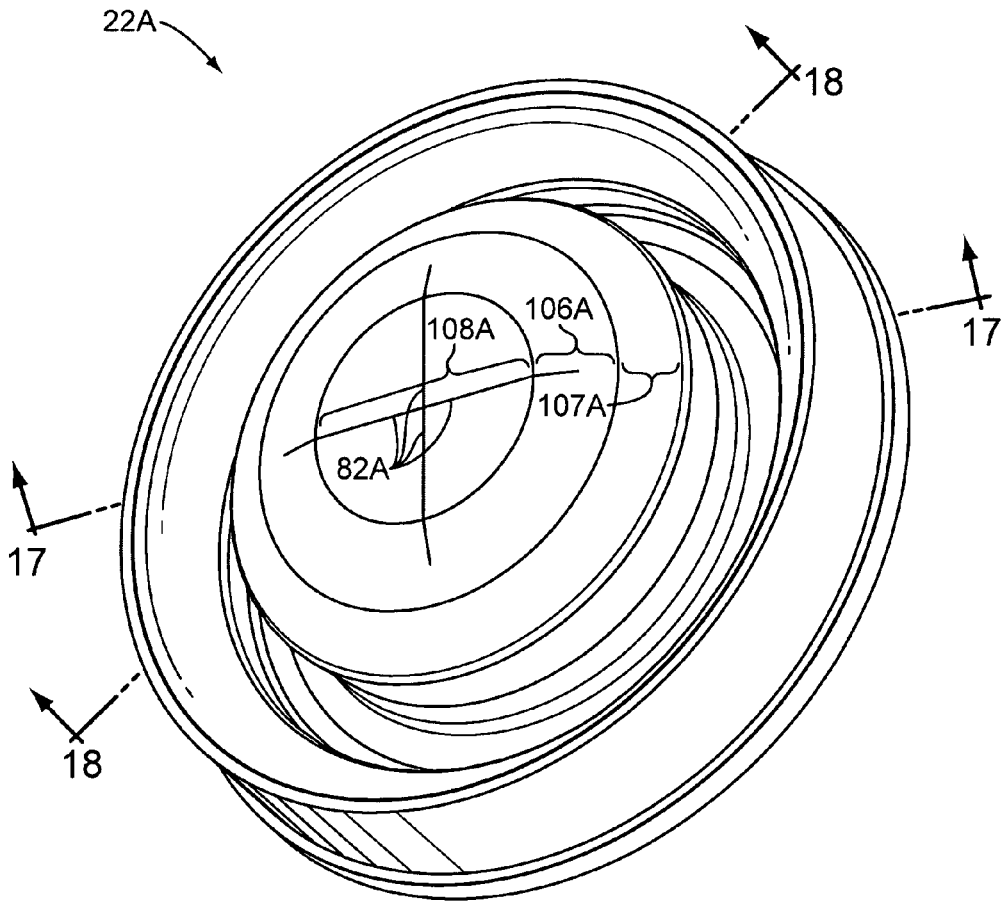
FIG. 16 is an isometric view of the interior surface of a second embodiment of a valve prior to installation in the closure.

The valve 22 is flexible and changes configuration between (1) a retracted, closed, rest position (as shown closed in FIG. 1A in the closure 20 having an orientation that the closure 20 would have if mounted on a container in a package that has been inverted prior to dispensing the fluent substance from the container through the valve 22), and (2) an extended, active, open position (as shown in FIGS. 9, 10, and 11 when the inverted package is dispensing a fluent product). With reference to FIG. 5, the valve 22 includes (1) a peripheral mounting portion or flange 74, (2) a flexible, central wall, valve head portion, or head 76, and (3) a connector sleeve 78 that extends between, and connects, the flange 74 and head 76. When the valve 22 is not actuated and is in the retracted, closed, rest position (FIG. 1A), the head 76 has a concave configuration (when viewed from the exterior of the closure 20 as shown in FIG. 1A).

Figure 2:
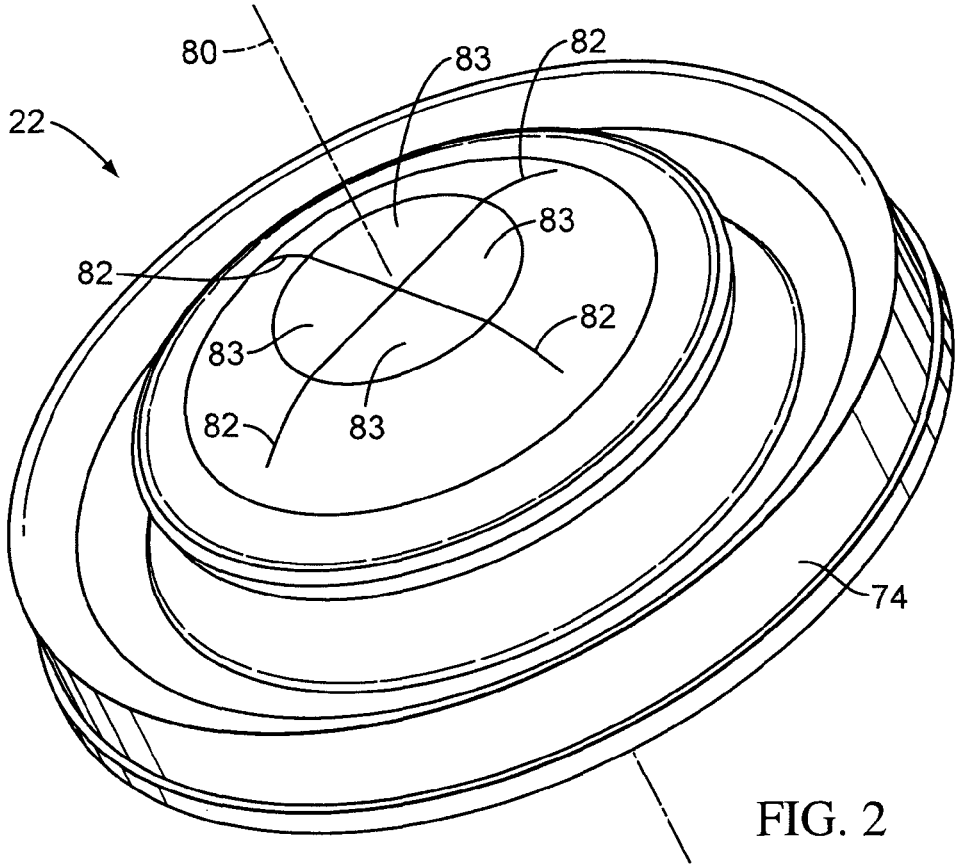
FIG. 2 is an isometric view of the interior surface of the valve shown in FIG. 1, but with the valve removed from the closure.
Figure 3:
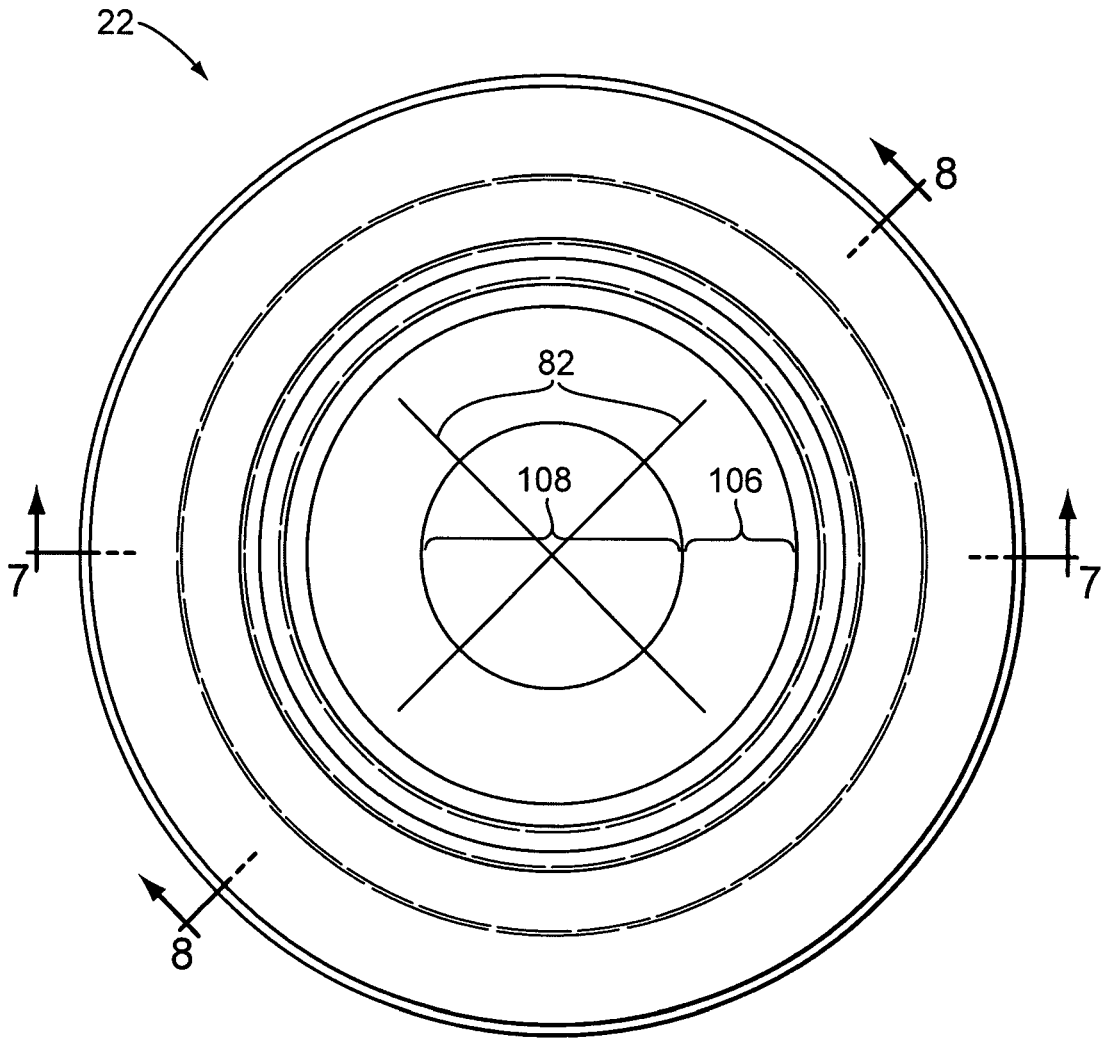
FIG. 3 is a top plan view of the interior surface of the valve.
Figure 7:
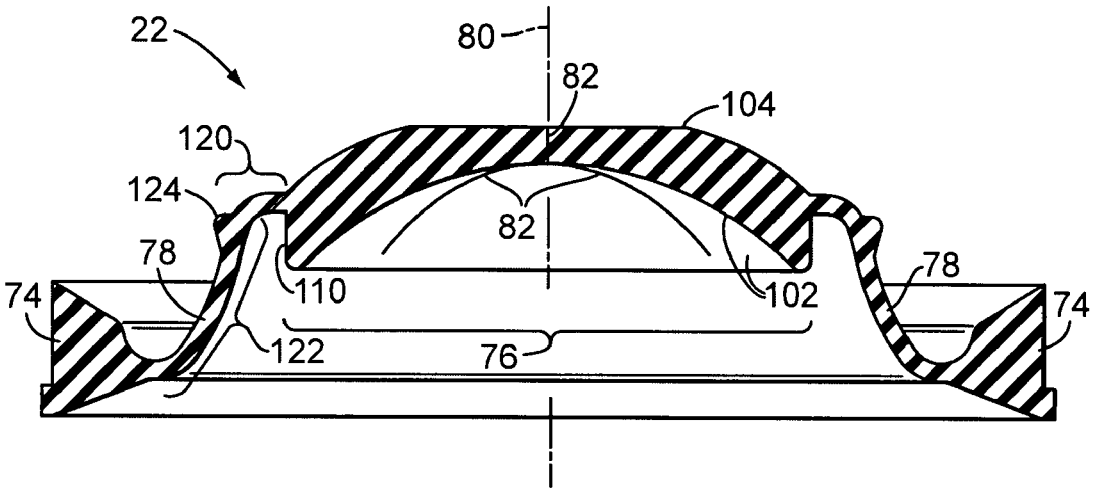
FIG. 7 is a cross-sectional view taken generally along the plane 7-7 in FIG. 3.
Figure 8:
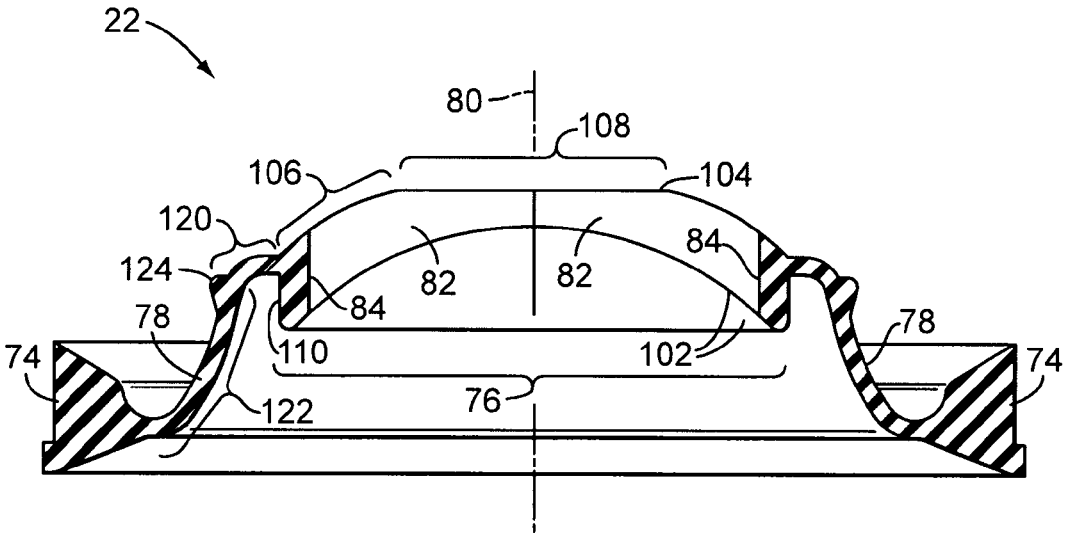
FIG. 8 is a cross-sectional view taken generally along the plane 8-8 in FIG. 3.

As illustrated in FIGS. 2, 3 and 8 for the first, preferred embodiment, the valve 22 has a generally circular configuration about the central longitudinal axis 80 extending through the valve 22 (FIG. 3). In the one preferred embodiment illustrated in FIGS. 7 and 8, the flange 74, sleeve 78, and head 76 are oriented in a generally circular configuration and concentric relationship relative to a longitudinal axis 80 along which the fluid substance can be dispensed from the valve 22 in a discharge flow direction. The valve 22 may be characterized as having an axially outward direction that is defined by the discharge flow direction. The valve 22 may also be characterized as having an axially inward direction that is defined as a direction opposite to the axially outward direction.

The head 76 of the valve 22 has a dispensing orifice which, in the preferred embodiment, is defined by one or more slits 82 (FIGS. 2, 3, and 7). Preferably, there are two or more slits 82 radiating from the longitudinal axis 80. More preferably, there are four slits 82 that radiate from the axis 80. The four radiating slits 82 may be alternatively characterized as two intersecting cross slits 82. A lesser or greater number of slits 82 could be used. The slits 82 preferably extend radially (transversely) in, and longitudinally through, the thickness of the head 76 in orientations that contain, and are parallel to, the longitudinal axis 80.

In one preferred embodiment, the slits 82 extend laterally from a common origin on the longitudinal axis 80 to define four flaps or petals 83 (FIGS. 2 and 11) which can flex outwardly (as seen in FIG. 11) to selectively permit the flow of product from the container through the valve 22. The flaps 83 open outwardly from the intersection point of the slits 82 in response to an increasing pressure differential across the valve when the pressure differential is of sufficient magnitude as generally described in the U.S. Pat. No. 5,409,144.

As can be seen in FIG. 5, in a presently preferred arrangement, each slit 82 terminates in a radially outer end 84 in the valve head 76. Preferably, the slit ends 84 are oriented along straight lines that are parallel to the longitudinal axis 80 (FIG. 8). In one preferred design, the slits 82 are of equal radial length, although the slits 82 could be of unequal length. In a preferred embodiment, each slit 82 is planar, and the plane of each slit 82 contains the central, longitudinal axis 80 of the valve 22. Preferably, the slits 82 diverge radially from an origin on the longitudinal axis 80 and define equal size angles between each pair of adjacent slits 82 so that the flaps 83 (FIG. 2) are of equal size. Preferably, the four slits 82 diverge at 90 degree angles to define two mutually perpendicular, intersecting, longer slits. Preferably, the slits 82 are formed so that the opposing side faces of adjacent valve flaps 83 closely seal against one another when the dispensing orifice defined by the slits in its normal, fully closed position. The length and location of the slits 82 can be adjusted to vary the predetermined opening pressure of the valve 22, as well as other dispensing characteristics.

The valve 22 could be molded with the slits 82. Alternatively, the valve could be molded without the slits, and the slits 82 could be subsequently cut into the central head 76 of the valve 22 by suitable conventional techniques. It is to be understood that the valve dispensing orifice may be defined by structures other than the illustrated slits 82. If the orifice is defined by slits, then the slits may assume other shapes, sizes and/or configurations in accordance with the dispensing characteristics desired. For example, the orifice may also include five or more slits.

The valve 22 connector skirt or sleeve 78 extends from the valve head 76 to the peripheral mounting portion 74. At the outer end of the sleeve 78, the sleeve 78 merges with the enlarged, much thicker, peripheral mounting portion or flange 74 which has a generally dovetail-shaped, longitudinal cross section (as viewed in FIGS. 7 and 8).

Figure 4:
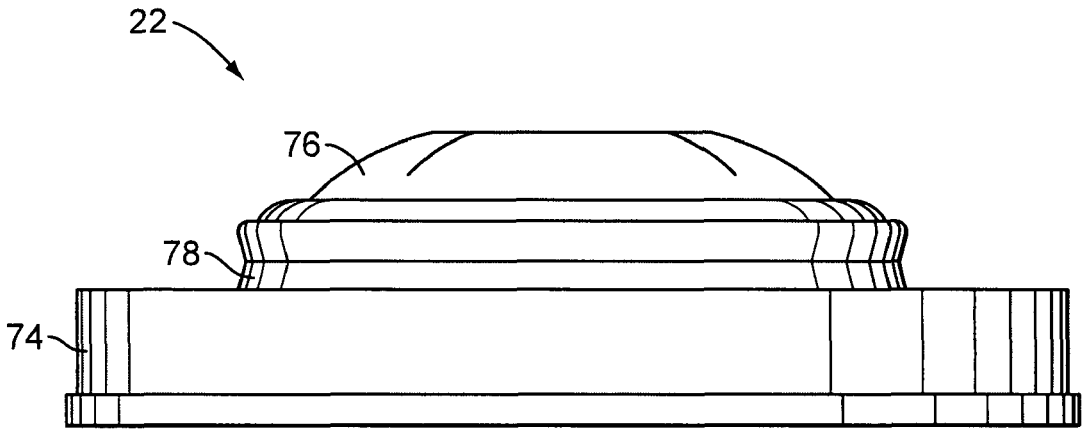
FIG. 4 is a side elevational view of the valve.

To accommodate the seating of the valve 22 in the closure body 30 (as shown in FIGS. 3 and 4), the outwardly facing surface of the dovetail valve flange 74 has the same frustoconical configuration and angle as the closure body frustoconical surface 70 (FIG. 1A).

The other surface of the valve flange 74 (i.e., the inwardly facing surface) is clamped by the retaining ring 34 (FIGS. 1 and 1A). The retaining ring 34 includes an upwardly facing, frustoconical, annular clamping surface 90 (FIG. 1A) for engaging the inner surface of the valve flange 74 at an angle which matches the angle of the adjacent, inner surface of the dovetail configuration valve flange 74.

The peripheral portion of the retaining ring 34 includes an outwardly projecting shoulder or bead 94 (FIG. 1A) for snap-fit engagement with the inside of the closure body collar 72 adjacent a bead 98 (FIG. 1A) projecting inwardly from the collar 72, and this holds the ring 34 tightly in the closure body 30 so as to clamp the valve 22 tightly inside the closure body 30. The interior of the ring 34 is large enough to permit the region adjacent the valve sleeve 78 to be substantially open, free, and clear so as to accommodate movement of the valve sleeve 78 as described hereinafter.

The novel configuration of the valve 22 will next be more specifically described with reference to FIGS. 7 and 8, among others. The valve head 76 may be characterized as having an exterior surface 102. The exterior surface 102 can interface with environment on the valve exterior. The exterior surface 102 has a generally recessed configuration as viewed from the valve exterior when the valve head 76 is in the fully retracted, closed position (as shown in FIGS. 1 and 1A).

The valve head 76 also includes an interior surface 104 (FIGS. 7 and 8). The interior surface 104 can interface with fluid substance on the valve interior. As can be seen in FIGS. 3, 5 and 8, the valve head interior surface 104 includes a radially outer surface portion 106 with a convex arcuate configuration as viewed from the valve interior when the valve is in the fully retracted, closed position. As can be seen in FIG. 5, in the preferred form of the valve 22, the valve orifice slits 82 each extends radially outwardly to at least the radially outer surface portion 106 (see also FIG. 8).

The valve head interior surface 104 further includes a central inner surface portion 108 that (1) is radially inside the radially outer surface portion 106, and (2) has a generally circular, planar configuration. In other contemplated embodiments (not illustrated), the valve head 76 could have other configurations (e.g., the interior surface could be continuously arcuate without a planar central inner surface portion 108).

The valve head 76 has a peripheral surface 110 (FIGS. 5, 7, and 8) that extends from the exterior surface 102 toward the interior surface 104. In the first embodiment illustrated in FIGS. 5, 7, and 8, the peripheral surface 110 is a cylindrical surface that is parallel to the longitudinal axis 80 when the valve is in the fully retracted, closed position.

The connector sleeve 78 extends from the peripheral portion of the valve head 76 and defines a generally tubular shape over at least part of the sleeve length. More particularly, the sleeve 78 defines a generally tubular wall which, when viewed in a transverse cross section along a plane perpendicular to the longitudinal axis 80, has generally annular cross-section when the valve 22 is in the fully retracted, closed position. As can be seen in FIG. 7, in this illustrated form of the valve 22, the sleeve 78 has a first portion 120 that extends laterally or radially outwardly from a location at the most axially inward extent of the valve head peripheral surface 110. Most preferably, the interior side surface of the sleeve 78 (including the sleeve portion 120) is connected to the valve head interior surface 104 at the circumference of the valve head interior surface 104.

At the radially outer periphery of the sleeve portion 120, the sleeve 78 has a second portion 122 which extends in the axially outward direction (downwardly as viewed in FIGS. 7 and 8) but which also flares radially outwardly somewhat until it joins the valve peripheral mounting portion or flange 74. With reference to FIGS. 7 and 8, the connector sleeve 78 may also be characterized as generally flaring radially outwardly adjacent the valve head peripheral surface 110. Further, the diameter of the exterior side of the tubular wall of the sleeve 78 may be characterized as increasing with increasing axially outward distance along the sleeve 78.

Further, in the first embodiment of the valve 22 illustrated in FIGS. 1-15, the valve connector sleeve 78 includes a radially outwardly projecting, annular, stiffening bead 124 (FIGS. 7 and 8).

The connector sleeve 78 is relatively flexible and resilient so that when the valve 22 is subjected to a sufficient pressure differential, the sleeve 78 can double over and extend rollingly in the axially outward direction (away from the container interior) as the valve head 76 moves from the fully retracted, closed position (FIGS. 1A, 2, 5, 7, and 8) to an extended position (FIGS. 9, 10 and 11) that is axially outward of the fully retracted, closed position whereby the opening of the orifice defined by the slits 82 is accommodated.

In order to dispense product, the package is typically tipped downwardly, or is completely inverted, and then squeezed. FIGS. 1 and 1A show the orientation of a valve 22 in the closure 20 when the user inverts the package and then squeezes the container 33 (FIG. 1). (Or, alternatively, the exterior atmospheric pressure could be reduced adjacent the exterior side of the valve 22.) The container 33 (FIG. 1) is typically squeezed to increase the pressure within the container above the ambient exterior atmospheric pressure. This forces the product in the container toward and against the valve 22, and that forces the valve 22 from the recessed or retracted position (shown in FIGS. 1-8) toward an outwardly extending position (shown in FIGS. 8A-11). The outward displacement of the central head 76 of the valve 22 is accommodated by the relatively thin, flexible sleeve 78. The sleeve 78 moves from the inwardly projecting, rest position to an outwardly displaced, pressurized position, and this occurs as a result of the sleeve 78 "rolling" along itself outwardly toward the outer end of the package (toward the position shown in FIG. 8A).

Figure 8A:
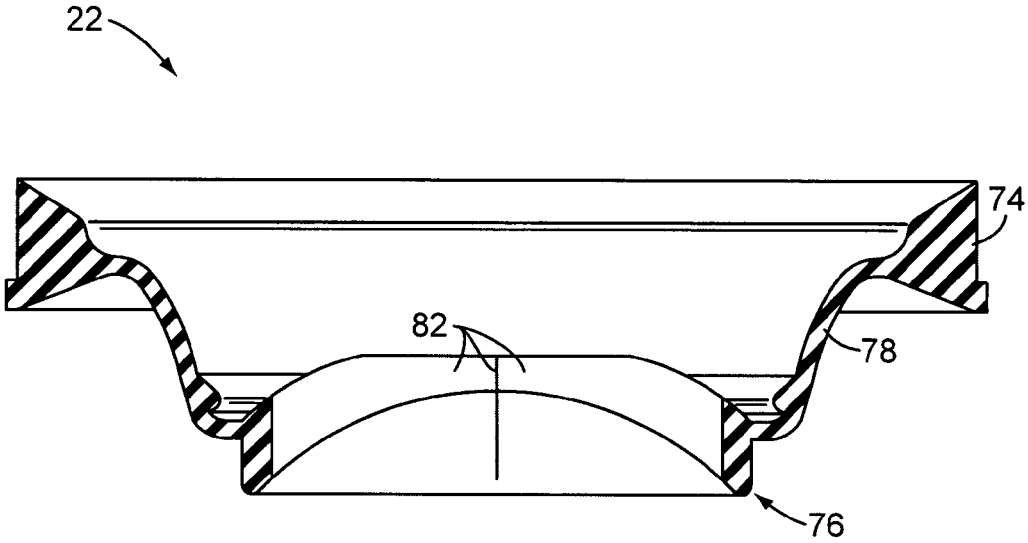
FIG. 8A is a view similar to FIG. 8, but FIG. 8A shows the valve head moved (in response to a pressure differential across the valve) to a substantially fully extended position just prior to the valve opening to discharge a fluent substance.

During the valve opening process, the valve head 76 is initially displaced outwardly while still maintaining its generally concave, closed configuration. The initial outward displacement of the closed, concave head 76 is accommodated by the relatively, thin, flexible, sleeve 78. The sleeve 78 moves from the recessed, rest position to a pressurized position wherein the sleeve 78 extends outwardly toward, and could even extend beyond, the open end of the structure in which the valve 22 is mounted (FIG. 8A). That is, when the valve head 76 is moved toward the fully extended position, the sleeve 78 extends axially outwardly (i.e., outwardly in the discharge flow direction of the substance to be dispensed through the valve 22). However, the valve 22 does not open (i.e., the slits 82 do not open) until the valve head 76 has moved substantially all the way to a fully extended position (FIG. 8A). Indeed, as the valve head 76 moves axially outwardly, the valve head 76 is subjected to radially inwardly directed compression forces which tend to further resist opening of the slits 82. Further, the valve head 76 generally retains its closed configuration as it moves forward and even after the sleeve 78 and valve head 76 reaches the fully extended position (FIG. 8A). However, when the internal pressure becomes sufficiently great compared to the external pressure, then the slits 82 in the extended valve head 76 quickly open to dispense product (FIGS. 9-11). The fluent material is then expelled or discharged through the open slits 82.

The above-discussed dispensing action of valve 22 typically would occur only after (1) a lid (if any) has been moved to an open position, (2) the package has been tipped or inverted, and (3) the container is squeezed. Pressure on the interior side of the valve 22 will cause the valve to open when the differential between the interior and exterior pressure reaches a predetermined amount. Preferably, the valve 22 is designed to open only after a sufficiently great pressure differential acts across the valve (e.g., as caused by squeezing the container with sufficient force (if the container is not a rigid container), and/or as caused by a sufficiently reduced pressure (i.e., vacuum) applied to the exterior of the valve 22).

The novel design of the present invention advantageously functions to provide a more gentle opening with less spurting of the discharging fluent substance and with more control over the discharging fluent substance owing to the connection of the connector sleeve 78 to the valve head 76 at a location of the connection that is at the axially most inward extent of the valve head peripheral surface 110. This may be regarded as somewhat of a "hinge" point for the valve head 76 relative to the connector sleeve 78. This hinge-like attachment or connection of the connector sleeve 78 to the valve head 76 contributes to a more gentle opening process with less spurting of the discharging fluent substance and with more control over the dispensing process.

Depending on the particular valve design, the open valve 22 may close when the pressure differential decreases, or the valve may stay open even if the pressure differential decreases to zero. In the preferred embodiment of the valve 22 illustrated in FIGS. 1-15, the valve 22 is designed to close when the pressure differential decreases to, or below, a predetermined magnitude. Thus, when the squeezing pressure on the container is released, the valve 22 eventually closes, and the valve head 76 retracts to its recessed, rest position within the closure 20.

Preferably, the valve 22 is designed to withstand the weight of the fluid on the inside of the valve 22 when the container 33 is completely inverted. With such a design, if the container 33 is inverted, but not squeezed while the valve 22 is closed, then the mere weight of the fluent material on the valve 22 does not cause the valve 22 to open, or to remain open. Further, if the container on which the closed valve 22 is mounted is inadvertently tipped over (after a lid, if any is opened), then the product still does not flow out of the valve 22 because the valve 22 remains closed.

In one preferred embodiment of the valve 22, the valve petals 83 open outwardly only when the valve head 76 is subjected to a predetermined pressure differential acting in a pressure gradient direction wherein the pressure on the valve head interior surface 104 exceeds—by a predetermined amount—the local ambient pressure on the valve head exterior surface 102. The product can then be dispensed through the open valve 22 until the pressure differential drops below a predetermined magnitude, and the petals 83 then close completely.

The valve 22 can also be designed to be flexible enough to accommodate in-venting of ambient atmosphere (as described in detail below), so that the closing petals 83 can continue moving further inwardly to allow the valve 22 to open inwardly as the pressure differential gradient direction reverses wherein the pressure on the valve head exterior surface 102 exceeds the pressure on the valve bead interior surface 104 by a predetermined magnitude.

For some dispensing applications, it may be desirable for the valve 22 not only to dispense the product, but also to accommodate such in-venting of the ambient atmosphere (e.g., so as to allow a squeezed container (on which the valve is mounted) to return to its original shape). Such an in-venting capability can be provided by selecting an appropriate material for the valve construction, and by selecting appropriate thicknesses, shapes, and dimensions for various portions of the valve head 76 for the particular valve material and overall valve size. The thickness, shape, flexibility, and resilience of the valve head, and in particular, of the petals 83, can be designed or established so that the petals 83 will deflect inwardly (as shown in FIGS. 12-15) when subjected to a sufficient pressure differential that acts across the head 76 in a gradient direction that is the reverse or opposite from the pressure differential gradient direction during product dispensing. Such a reverse pressure differential can be established when a user releases a squeezed, resilient container on which the valve 22 is mounted. The resiliency of the container wall (or walls) will cause the wall to return toward the normal, larger volume configuration. The volume increase of the container interior will cause a temporary, transient drop in the interior pressure. When the interior pressure drops sufficiently below the exterior ambient pressure, the pressure differential across the valve 22 will be large enough to deflect the valve petals 83 inwardly to permit in-venting of the ambient atmosphere. In some cases, however, the desired rate or amount of in-venting may not occur until the squeezed container is returned to a substantially upright orientation that allows the product to flow under the influence of gravity away from the valve 22.

When the valve 22 is used with a container, the valve 22 is preferably configured for use in conjunction with the particular container, and with a specific type of product, so as to achieve the desired dispensing characteristics (and optional in-venting characteristics). For example, the viscosity and density of the fluid product can be factors in designing the specific configuration of the valve 22 for liquids, as are the shape, size, and strength of the container. The rigidity and durometer of the valve material, and size and shape of the valve head 76, are also relevant to achieving the desired dispensing characteristics, and can be matched with both the container and the fluent substance to be dispensed therefrom.

It has been found that the novel configuration of the valve 22, especially the location of the attachment of the connector sleeve 78 to valve head 76, provides improved performance with respect to in-venting. This valve 22 permits the valve to be designed to better accommodate in-venting—even where the container provides only a relatively weak in-venting pressure differential across the valve 22.

FIGS. 16-22 illustrate a second embodiment of the valve of the present invention, and in FIGS. 16-22, the second embodiment of the valve is designated generally by the reference number 22A. In FIGS. 16-22, the second embodiment of the valve 22A is shown generally in an orientation which it would have if the valve 22A was installed in a closure, such as the closure 20 described above with reference to FIGS. 1 and 1A, and if that closure was installed on an inverted container, such as the container 33 described above with reference to FIG. 1.

Figure 17:
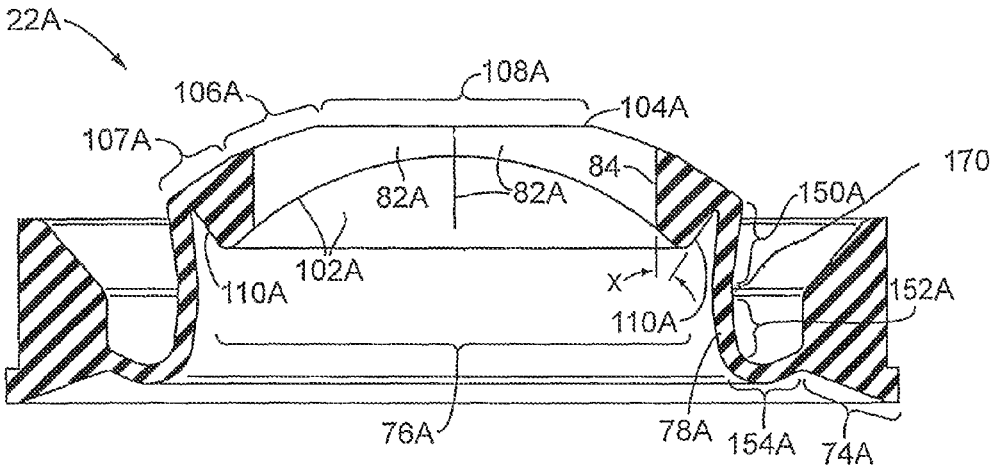
FIG. 17 is a cross-sectional view taken generally along the plane 17-17 in FIG. 16.
Figure 18:
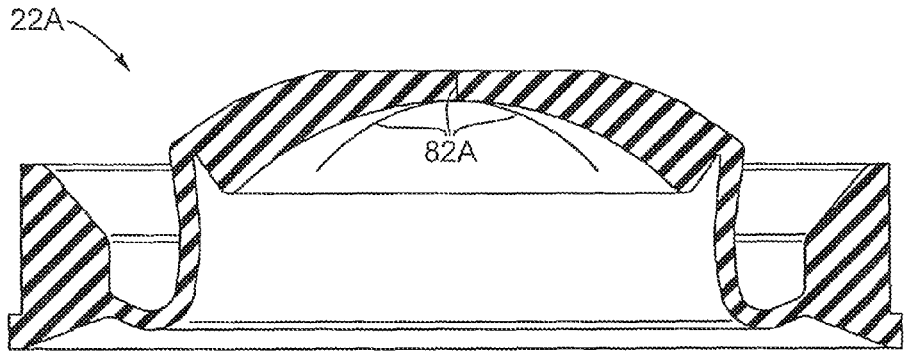
FIG. 18 is a cross-sectional view taken generally along the plane 18-18 in FIG. 16.
Figure 19:
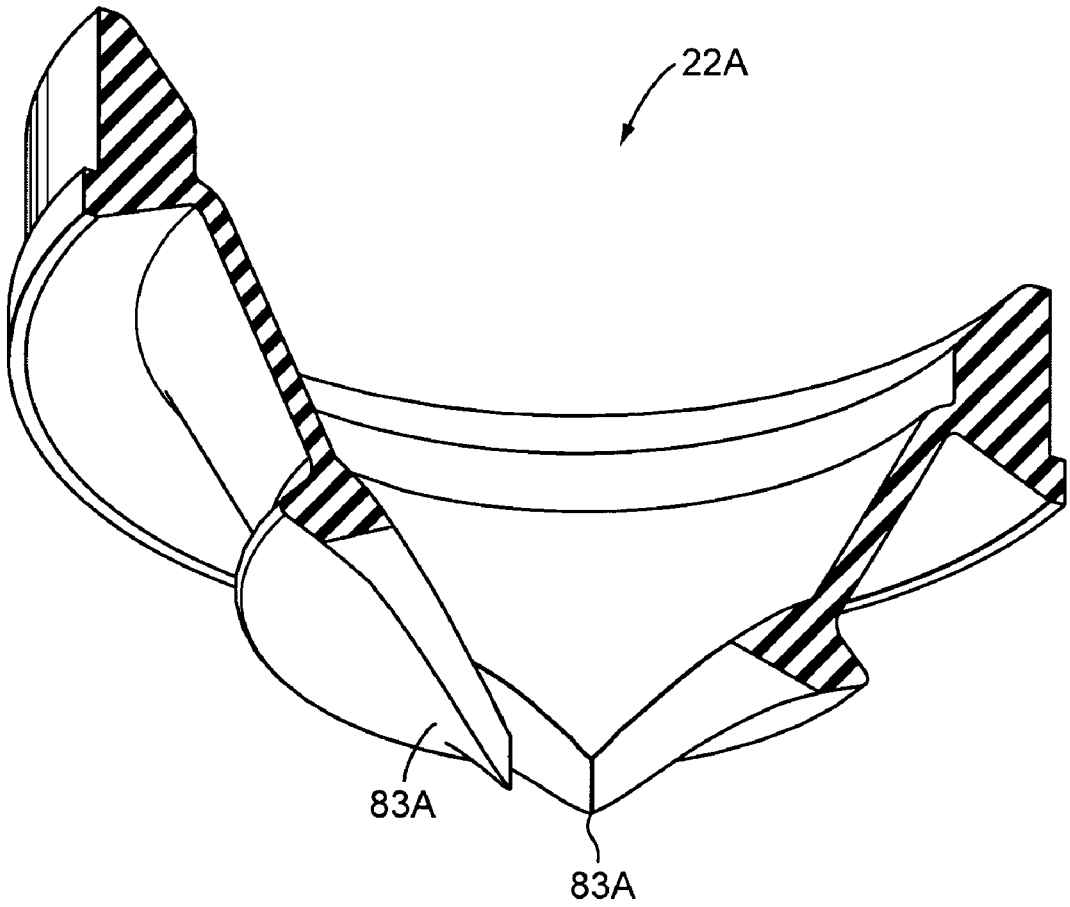
FIG. 19 is an isometric view of the second embodiment of the valve partially in cross section showing the valve in a fully opened, discharging configuration.
Figure 20:
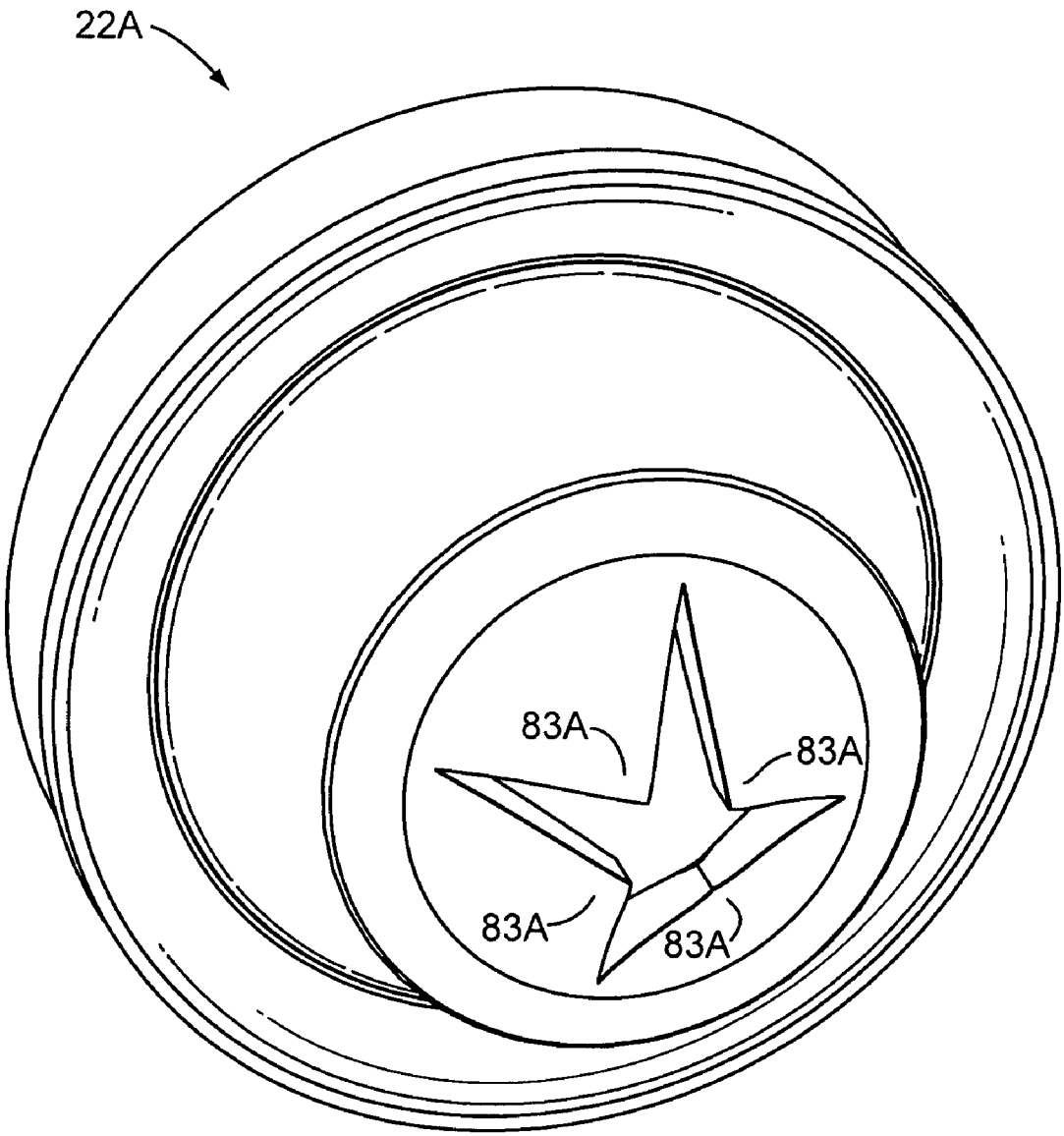
FIG. 20 is an isometric view of the second embodiment of the valve in the fully opened, discharging configuration corresponding to the same configuration illustrated in FIG. 19.

The second embodiment of the valve 22A is generally similar to the first embodiment of the valve 22 described above with reference to FIGS. 1-15. With reference to FIG. 17, the second embodiment of the valve 22A includes a peripheral mounting portion or flange 74A, a valve head 76A, and a connector sleeve 78A. The sleeve 78A is flexible and resilient, defines a generally tubular shape over at least part of the length of the sleeve 78A, and extends between, and connects, the peripheral mounting portion of flange 74A with the valve head 76A.

The valve head 76A of the second embodiment of 22A differs somewhat from the first embodiment valve head 76. Specifically, with reference to FIG. 17, the second embodiment valve head 76A has a peripheral surface 110A which is not cylindrical as in the first embodiment valve head peripheral surface 110. Rather, the second embodiment of valve head peripheral surface 110A is a frustoconical surface which tapers radially inwardly with increasing distance in the axially outward direction (the axially outward direction is the fluent substance discharge flow direction out of the valve, and that direction is downwardly as the valve is viewed in FIG. 17).

Figure 21:
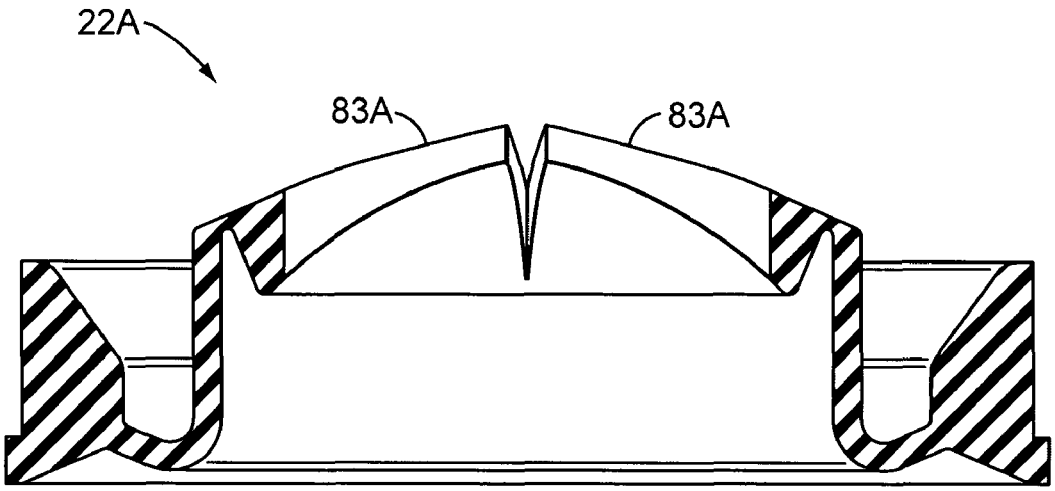
FIG. 21 is a view similar to FIG. 17, but FIG. 21 shows a cross-sectional view of the second embodiment of the valve in a partly inwardly opened, in-venting configuration.
Figure 22:
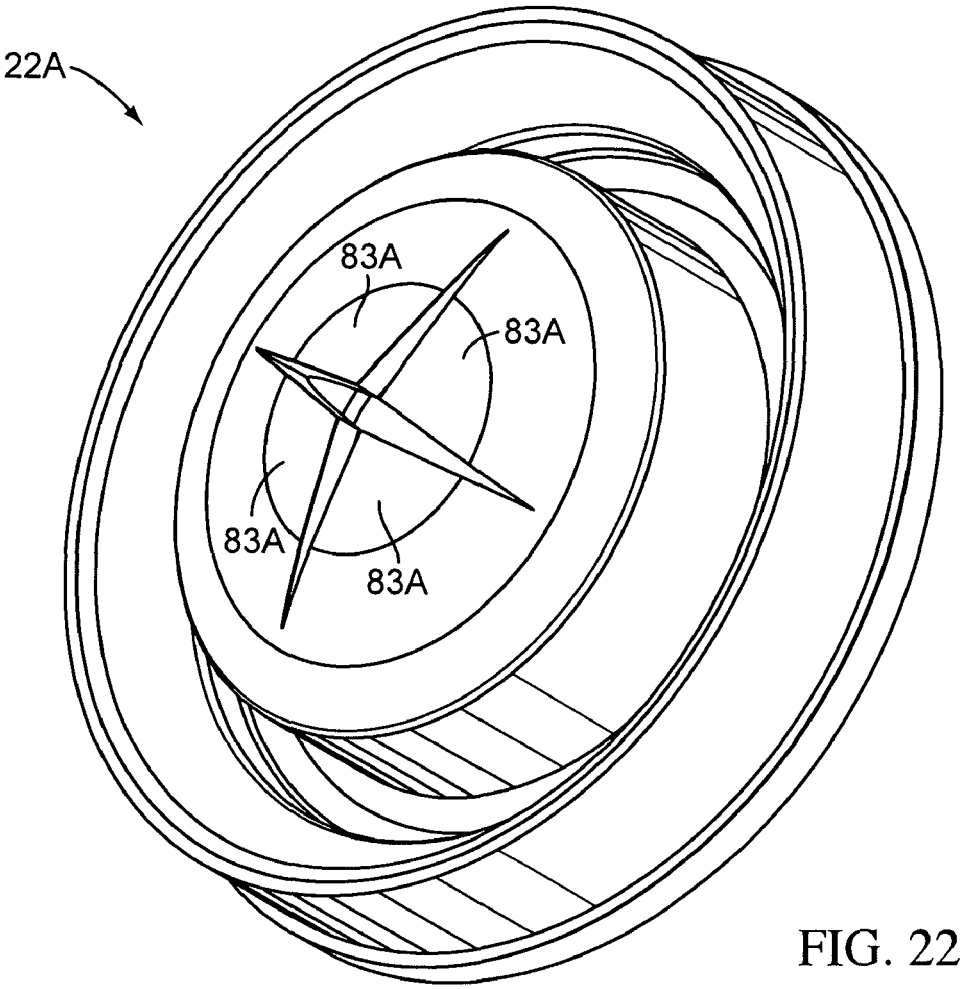
FIG. 22 is an isometric view showing the second embodiment of the valve in the partially, inwardly opened, in-venting configuration corresponding to the configuration illustrated in FIG. 21.

The second embodiment valve head 76A includes one or more slits 82A, such as the illustrated four intersecting cross slits 82A shown in FIGS. 16-22. The slits 82A defines flaps or petals 83A which can open to discharge the fluid substance from the container through the valve (FIGS. 19 and 20) and which can open axially inwardly to accommodate in-venting into the container (FIGS. 21 and 22). Depending upon the particular application in which the valve 22A is used, it may not be necessary to make the valve so flexible as to accommodate in-venting if in-venting is not necessary or desired.

In the preferred form of the second embodiment of the valve 22A, the valve head 76A (FIG. 17) has an exterior surface 102A having the same configuration as the exterior surface 102 of the first embodiment of the valve 22 discussed above with reference to FIGS. 1-15. The valve head 76A of the second embodiment of valve 22A also includes an interior surface 104A that has (1) a radially outer, frustoconical surface portion 107A, (2) an intermediate, arcuate (partially spherical) surface portion 106A, and (3) a central, inner surface portion 108A. The central, inner surface portion 108A has the same planar configuration and orientation as the corresponding surface 108 in the first embodiment of the valve 22 described above with reference to FIGS. 1-15.

In the preferred arrangement, the second embodiment of valve 22A, the valve slits 82A have an orientation wherein each valve slit 82A terminates in a radially outer end 84 (FIG. 17), and that slit outer end 84 is oriented along a straight line that is parallel to the longitudinal axis of the valve. As can be seen in FIG. 17, there is an angle X between the line defining the slit end 84 in the valve head 76 and the frustoconical peripheral surface 110A. In a presently preferred embodiment, the angle X is about 35 degrees. In the presently contemplated preferred forms of the invention, the angle X has a preferred range between about 0 degrees and about 45 degrees.

As can be seen in FIG. 17, the second embodiment connector sleeve 78A has an axially inner portion or first portion 150A which flares slightly radially outwardly adjacent the valve head peripheral surface 110A. The sleeve portion 150A and the peripheral surface 110A may be regarded as defining an included angle between them which is not more than 90 degrees, and which in the preferred form illustrated in FIG. 17, is less than 90 degrees.

The connector sleeve 78A includes a second portion 152A (FIG. 17) which extends from the first portion 150A, with the second portion 152A and the first portion 150A intersecting at a minimum diameter 170. The second portion 152A flares slightly radially outwardly from the first portion 150A toward the peripheral mounting portion or flange 74A.

Finally, the connector sleeve 78A includes a third portion 154A which extends between the second portion 152A and the peripheral mounting portion or flange 74A. The connector sleeve third portion 154A includes a reversely curved, or arcuate, configuration which extends further radially outwardly and which also extends to a location somewhat axially inwardly to a location where the third portion 154A joins the valve mounting flange 74A.

Unlike the first embodiment of valve 22 discussed above with reference to FIGS. 1-15, the second embodiment of the valve 22A does not include an annular stiffening bead (i.e., the stiffening bead 124 described above with reference to the first embodiment illustrated in FIG. 5).

Like in the first embodiment of the valve 22, the attachment location of the second embodiment valve connector sleeve 78A to the valve head 76A is at the most axially inward extent of the valve head peripheral surface 110A. Most preferably, the interior side of the sleeve 78A is connected to the valve head interior surface 104A at the circumference of the valve head interior surface 104A. It has been found that this configuration contributes to the improved operating characteristics of the valve, especially with respect to providing a more gentle opening with less spurting and more dispensing control.

The second embodiment of the valve 22A operates in a manner similar to that described above for the operation of the first embodiment of the valve 22 illustrated in FIGS. 1-15. The second embodiment of the valve 22A can be designed to be flexible enough to readily accommodate in-venting where that is desirable, and the in-venting of the valve flaps 83A is shown in FIGS. 21 and 22.

It will be readily observed from the foregoing detailed description of the invention and from the illustrations thereof that numerous other variations and modifications may be effected without departing from the true spirit and scope of the novel concepts or principles of this invention.

What is claimed is:

1. A fluid dispensing valve having a generally circular configuration relative to a longitudinal axis along which a fluid substance is dispensed from said valve in a discharge flow direction, said valve having an axially outward direction that is defined by said discharge flow direction, and said valve having an axially inward direction that is defined as the direction opposite to said axially outward direction, said valve comprising:

(A) a peripheral mounting portion;

(B) a valve head that is located axially inwardly further than said peripheral mounting portion, and that is flexible and resilient, said valve head having (1) a normally closed orifice that is defined by at least one slit and that opens to permit a discharge flow of said substance, (2) a fully retracted, closed position that is axially inward of at least another part of said valve, (3) an exterior surface which (a) interfaces with the environment on the valve exterior, (b) has a generally recessed configuration as viewed from the valve exterior when said valve head is in the fully retracted, closed position, and (4) an interior surface which (a) interfaces with a fluid substance on the valve interior, (b) projects generally in the axially inward direction when viewed from the valve interior when the valve head is in the fully retracted, closed position, and (5) a peripheral surface extending from said exterior surface toward said interior surface;

(C) a connector sleeve that (1) is flexible and resilient, (2) defines a generally tubular shape over at least part of the sleeve length, and (3) extends between, and connects, said peripheral mounting portion and said valve head in a configuration that, when said valve is subjected to a sufficient pressure differential, doubles over and extends rollingly in said axially outward direction as said valve head moves from said fully retracted, closed position to an extended position that is axially outward of said fully retracted, closed position and that accommodates opening of said orifice, said connector sleeve being connected to said valve head at a location that is at the most axially inward extent of said peripheral surface; and wherein said connector sleeve flares radially inwardly with increasing axial distance along said sleeve from the mounting portion to a minimum diameter of the sleeve and then continuously flares radially outwardly with increasing axial distance along said sleeve from the minimum diameter to the connection to the valve head with the valve head in the fully retracted, closed position.

2. The fluid dispensing valve in accordance with claim 1 wherein the connector sleeve extends axially outwardly beyond the peripheral surface of the head with the valve head in the fully retracted, closed position.

3. The fluid dispensing valve in accordance with claim 1 in which said valve head orifice is defined by a pair of intersecting slits, each said slit extending completely through the thickness of said valve head, and each said slit extending radially outwardly.

4. The fluid dispensing valve in accordance with claim 1 in which said connector sleeve is defined by a generally tubular wall having a generally uniform cross section.

5. The fluid dispensing valve in accordance with claim 1 in which said valve head exterior surface lies on a partially spherical locus that defines a circular arc in longitudinal cross section as viewed along a plane containing said longitudinal axis.

6. The fluid dispensing valve in accordance with claim 1 in which at least a portion of said valve head interior surface is a partially spherical surface that defines a circular arc as viewed in longitudinal cross section along a plane containing said longitudinal axis.

7. The fluid dispensing valve in accordance with claim 1 in which at least a portion of said valve head interior surface is a frustoconical surface.

8. The fluid dispensing valve in accordance with claim 1 in which said valve head interior surface includes an arcuate surface portion that is a partially spherical surface; and said valve head exterior surface lies on a partially spherical locus.

9. The fluid dispensing valve in accordance with claim 1 in which said connector sleeve has an interior side; and the interior side surface of said connector sleeve is connected at the circumference of said valve head interior surface at the periphery of said valve head.

10. The fluid dispensing valve in accordance with claim 1 in which said connector sleeve is defined by a generally tubular wall; and said tubular wall is connected to said valve head to define an included angle between said valve head peripheral surface and an adjacent portion of said tubular wall wherein said included angle is less than or equal to 90 degrees.

11. The fluid dispensing valve in accordance with claim 1 in which said valve head peripheral surface is a frustoconical surface which tapers radially inwardly with increasing distance in the axially outward direction.

12. The fluid dispensing valve in accordance with claim 1 in which, when said valve is viewed in longitudinal cross section along a plane containing said longitudinal axis, each said slit terminates radially outwardly along a line extending parallel to said longitudinal axis and through said valve head;

said valve head peripheral surface is frustoconical; and said line and said valve head peripheral surface define an angle of about 35 degrees.

* * * * *

UNITED STATES PATENT AND TRADEMARK OFFICE

CERTIFICATE OF CORRECTION

PATENT NO. : 8,397,956 B2
APPLICATION NO. : 11/728659
DATED : March 19, 2013
INVENTOR(S) : Olechowski It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1253 days.

Signed and Sealed this
Sixth Day of January, 2015

Michelle K. Lee

Michelle K. Lee
*Deputy Director of the United States Patent and Trademark Office*